United States Patent [19]

Hirano

[11] Patent Number: 4,754,886

[45] Date of Patent: Jul. 5, 1988

[54] RADIO CONTROL AERIAL AUTOMATIC CARRYING SYSTEM

[76] Inventor: Kozo Hirano, Minono-machi 93-1, Hitoyoshi-shi, Kumamoto-ken, Japan

[21] Appl. No.: 2,550

[22] Filed: Jan. 13, 1987

[51] Int. Cl.[4] ..... B66C 21/00

[52] U.S. Cl. ..... 212/76; 212/77; 212/80; 212/122; 212/207

[58] Field of Search ..... 212/71, 76, 77, 80, 212/82, 83, 85, 87, 89, 94, 96, 97, 104, 108, 110, 114, 116, 122, 124, 125, 140, 141, 142.1, 207; 104/112, 165, 173.1; 105/148, 163.1

[56] References Cited

U.S. PATENT DOCUMENTS

| | | | |
|---|---|---|---|
| 266,597 | 10/1882 | Ackerman | 212/80 |
| 3,710,726 | 1/1973 | Buchholz et al. | 212/207 |
| 4,500,004 | 2/1985 | Peters et al. | 212/80 |
| 4,515,281 | 5/1985 | Maki | 212/122 |
| 4,669,619 | 6/1987 | Kimblad | 212/77 |

FOREIGN PATENT DOCUMENTS 57-4596 1/1982 Japan .

*Primary Examiner*—Joseph F. Peters, Jr.
*Assistant Examiner*—Stephen P. Avila
*Attorney, Agent, or Firm*—Flynn, Thiel, Boutell & Tanis

[57] ABSTRACT

There is a radio control aerial automatic carrying system for carrying an object by a carrying apparatus suspended to a cableway. This system comprises: an aerial main cableway for suspending the carrying apparatus; running wheels suspended to the aerial main cableway; an outer casing coupled with the running wheels and formed by a hollow body; a power source and a hydraulic apparatus which are attached to the outer casing; hoisting cables which are wound and driven by the power source; a receiver, attached to the outer casing, for receiving radio waves which are transmitted from a transmitter and for generating control commands to drive the power source, hydraulic apparatus, and hoisting cables in response to the radio waves received; two rotary shafts attached to the outer casing and rotated by the power source; sub cableways, suspended in parallel with the aerial main cableway, for supporting the carrying apparatus; and drive wheels, attached to the rotary shafts, for moving the carrying apparatus by operating the sub cableways. The frictions between the drive wheels and the sub cableways are enlarged, so that the slip of the carrying apparatus is prevented. The outer casing is also used as the operating oil tank and fuel oil tank. The structure of the carrying apparatus is simplified and reduced in size and weight.

11 Claims, 6 Drawing Sheets

RADIO CONTROL AERIAL AUTOMATIC CARRYING SYSTEM

FIELD OF THE INVENTION

The present invention relates to a radio control aerial automatic carrying system and, more particularly, to a radio control aerial automatic carrying system which is used to convey the cut woods in the felling forest and which can be safely certainly moved even in the steep slanting ground and also can be easily handled.

DESCRIPTION OF THE RELATED BACKGROUND ART

The aerial cableway is used as the carrying means for carrying the cut woods from the forest. The cut woods can be easily conveyed by the aerial cableway in the steep slanting region such as region between the mountains, region between the valleys, or the like.

The aerial cableway is constituted by suspending the steel cables between the summit of the mounting having the steep slanting surface and the foot of the mountain or in the valley between the mountains. The carrying apparatus which is operated by the radio wave is suspended to the steel cables, thereby suspending and transporting objects to be conveyed. The carrying apparatus has a power unit consisting of a power source and the like. Namely, the power source consisting of the internal combustion engine is attached to the outer casing of the carrying apparatus. The power source is coupled to the hoisting means such as hoisting drums or the like through the clutch and speed change apparatus such as an automatic speed change gear or the like. The hoisting means are respectively individually driven. The clutch and the speed change apparatus and the like are connected to a hydraulic apparatus consisting of a hydraulic motor or the like to make them operative.

Most of the conventional carrying apparatuses are of the type of what is called one-shaft and one-body such that one drive wheel to move the carrying apparatus while manually operating the sub cableway is attached to one rotary shaft. However, when the carrying apparatus is obliquely upwardly moved in the steep slanting district, there is such a problem that the drive wheel slips and the carrying apparatus is not smoothly moved because the friction which is caused between the drive wheel and the sub cableway is small and the like. On the other hand, when the carrying apparatus is moved downwardly, there is a fear of runaway of the carrying apparatus since the braking performance is bad, so that it is dangerous. Further, a large total weight of the carrying apparatus and objects to be conveyed acts on one sub cableway, so that there is such a risk that the sub cableway is likely to be cut away. Therefore, there is such a serious problem that the carrying apparatus recklessly runs if the sub cableway is cut away while the carrying apparatus is moving in the steep slanting region. Thus, the improvement of the conventional carrying apparatus is demanded.

On the other hand, the operating oil serving as the liquid for making the hydraulic apparatus operative is stored in the operating oil tank. The fuel oil serving as the liquid to make the power source operative is stored in the fuel oil tank. These tanks are separately disposed. Therefore, there are the following drawbacks. Namely, the number of parts increases. It is troublesome to attach those tanks. The whole structure of the carrying apparatus is complicated. The weight and size of carrying apparatus also increase. This makes it difficult to handle the carrying apparatus.

SUMMARY OF THE INVENTION

The present invention, therefore, is made to eliminate the foregoing drawbacks. It is an object of the invention to provide a compact radio control aerial automatic carrying system in which at least two rotary shafts are provided for the carrying apparatus, a drive wheel is attached to each rotary shaft, and a sub cableway is wound around the drive wheel so as to be manually operated, thereby enabling the carrying apparatus to be safely certainly moved even in the steep slanting region, and the liquid which is used for a power unit is stored in the hollow portion of the outer casing, and the outer casing is used as the liquid tank, so that the number of parts can be reduced, the constitution is simple, and the carrying apparatus can be easily handled.

According to the present invention, this object is accomplished by a radio control aerial automatic carrying system for carrying an object by a carrying apparatus suspended to a cableway, and this carrying system comprises: an aerial main cableway for suspending the carrying apparatus; running wheels suspended to the aerial main cableway; an outer casing which is coupled with the running wheels and formed by a hollow body; a power source attached to the outer casing; hoisting means which are wound and driven by the power source; a receiver, attached to the outer casing, for receiving radio waves which are transmitted from a transmitter and for generating control commands to drive the power source and the hoisting means in response to the radio waves received; at least two rotary shafts which are attached to the outer casing and rotated by the power source; a plurality of sub cableways, suspended in parallel with the aerial main cableway, for supporting the carrying apparatus; and a plurality of drive wheels, attached to the rotary shafts, for moving the carrying apparatus by operating the sub cableways.

According to the invention, at least two rotary shafts are provided, the drive wheel is attached to each rotary shaft, and the sub cableway is wound around each drive wheel. Therefore, the frictions which are caused between the drive wheels and the sub cableways can be increased. When the carrying apparatus is obliquely upwardly moved, the slip of carrying apparatus and the like are prevented. When the carrying apparatus is downwardly moved, the carrying apparatus is effectively braked. The operating performance can be improved. In addition, the total weight of the carrying apparatus and object which acts on each sub cableway can be reduced, so that the cut-away of the sub cableways can be avoided. Even if one of the sub cableways is cut away, the carrying apparatus can be held at the fixed position by the remaining sub cableways and the main cableway and it is safe. Moreover, the sub cableways can be selectively wound around a desired drive wheel. The use efficiency is improved.

The liquids which are used by the power unit are stored in the hollow portions of the outer casings formed by the hollow bodies and the outer casings are used as the liquid tanks. Thus, the operating oil tank of the hydraulic apparatus, the fuel oil tank, and the like do not need to be separately provided. The number of parts can be reduced. The constitution of the carrying apparatus can be simplified and reduced in size and weight. The carrying apparatus can be easily handled.

The above and other objects and features of the present invention will become apparent from the following detailed description and the appended claims with reference to the accompanying drawings.

BRIEF DESCRIPTION OF THE DRAWINGS

FIGS. 4 to 14 show modified forms of the first and second embodiments of the invention, in which FIGS. 4 to 6 are perspective views showing the suspending states of the carrying apparatuses, and FIGS. 7 to 14 are schematic plan views of the carrying apparatuses; and FIGS. 15 to 18 show the third embodiment of the invention, in which FIG. 15 is a front view of a carrying apparatus, FIG. 16 is a perspective view of an outer casing, FIG. 17 is a cross sectional view taken along the line XVII—XVII in FIG. 16, and FIG. 18 is a perspective view showing the state in which the carrying apparatus is suspended to a main cableway.

DESCRIPTION OF THE PREFERRED EMBODIMENTS

An embodiment of the present invention will now be described in detail hereinbelow with reference to the drawings.

Figure 1:
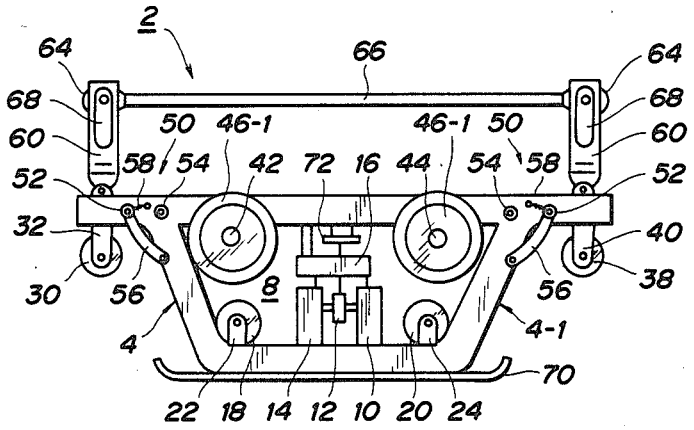
FIG. 1 is a front view of a carrying apparatus of the first embodiment of the invention.
Figure 2:
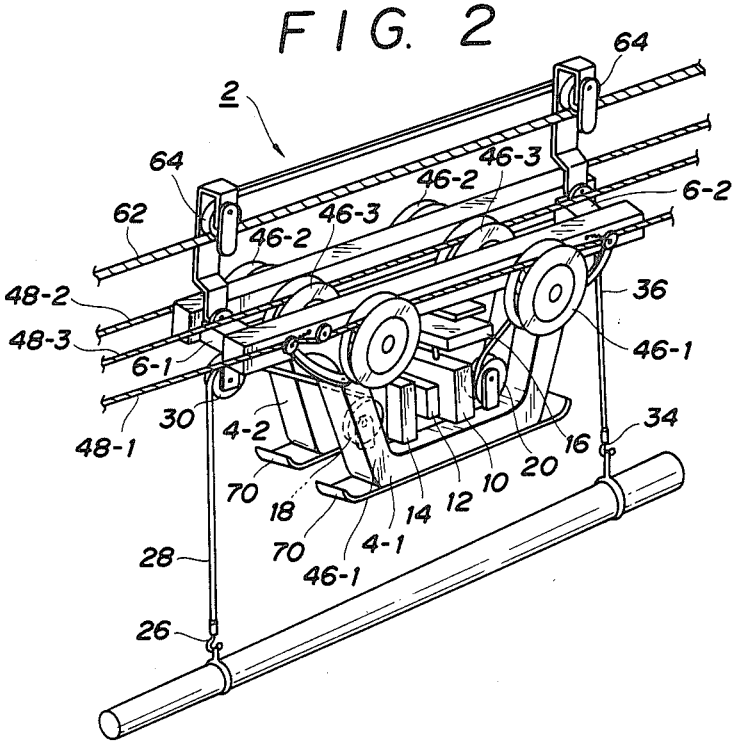
FIG. 2 is a perspective view illustrating the suspending state of the carrying apparatus of FIG. 1.

FIGS. 1 and 2 show the first embodiment of the invention. In the diagram, reference numeral 2 denotes a radio control aerial automatic carrying apparatus (hereinafter, simply referred to as a "carrying apparatus") and 4 denotes an outer casing of the carrying apparatus 2. The outer casing 4 consists of two outer casings 4-1 and 4-2 arranged in parallel. The outer casings 4-1 and 4-2 are generally referred to as the outer casing 4 hereinafter. The outer casings 4-1 and 4-2 are formed by hollow bodies and also serve as the tank for the operating oil of a hydraulic apparatus 16 and the tank for the fuel oil of a power source 10, which will be explained hereinafter. For this purpose, coupling portions 6-1 and 6-2 are attached to the upper portions on the front and rear end portions of the outer casings 4-1 and 4-2, thereby allowing the operating oil and fuel oil to flow therethrough. In this case, the upper surfaces of the coupling portions 6-1 and 6-2 are slightly lower than the upper surface of the outer casing 4, thereby allowing a sub cableway 48-3, which will be explained hereinafter, to pass. In addition, other coupling portions (not shown) are connected to the central lower portions of the outer casings 4-1 and 4-2, thereby allowing the operating oil and fuel oil to flow. A space or open region 8 adapted to accommodate the apparatuses such as power source and the like is formed in the outer casing 4. Namely, the power source 10, a clutch 12, a speed change apparatus 14 such as an automatic speed change gear, and the hydraulic apparatus 16 consisting of the hydraulic motor and the like are mounted in the space 8. The power source 10, clutch 12, and speed change apparatus 14 are driven by the hydraulic apparatus 16. The power source 10 is connected to first hoisting means 18 and second hoisting means 20 through the clutch 12, speed change apparatus 14, and transmitting means (not shown). The first and second hoisting means 18 and 20 are respectively individually operated by the power source 10. The first hoisting means 18 is fixed to the central bottom portion between the outer casings 4-1 and 4-2 by a first fixing device 22. The second hoisting means 20 is fixed to the central bottom portion between those outer casings by a second fixing device 24.

A first cable 28 is wound around the first hoisting means 18 and a first hook 26 is attached to the free end of the first cable 28 as shown in FIG. 2. The first cable 28 is vertically put down through the portion between the outer casings 4-1 and 4-2 and over a first guide pulley 30. The pulley 30 is supported by a first pulley supporting bracket 32 connected to the lower portion of the coupling portion 6-1. Similarly, a second cable 36 is also wound around the second hoisting means 20. A second hook 34 is attached to the free end of the second cable 36. The second cable 36 is vertically put down through the portion between the outer casings 4-1 and 4-2 and over a second guide pulley 38. The pulley 38 is supported by a second pulley supporting bracket 40 connected to the lower portion of the coupling portion 6-2. Therefore, by driving the first and second hoisting means 18 and 20, the first and second cables 28 and 36 are pulled in and out, thereby allowing an object to be moved up and down or laterally hung.

First and second rotary shafts 42 and 44 are disposed by attaching means (not shown) in the width direction perpendicular to the longitudinal direction of the outer casing 4. Both end portions of the first rotary shaft 42 are projected outwardly from the outside surfaces of the outer casings 4-1 and 4-2. A drive wheel 46-1 is attached to shaft 42 adjacent the outside of the outer casing 4-1. A drive wheel 46-2 is attached to shaft 42 adjacent the outside of the outer casing 4-2, namely, on the side opposite to the outer casing 4-1. A drive wheel 46-3 is attached to the first rotary shaft 42 so as to be sandwiched between the outer casings 4-1 and 4-2. Similarly, both end portions of the second rotary shaft 44 are projected outwardly from the outside surfaces of the outer casings 4-1 and 4-2. Another drive wheel 46-1 is attached to shaft 44 adjacent the outside of the outer casing 4-1. Another drive wheel 46-2 is attached to shaft 44 adjacent the outside of the outer casing 4-2, namely, on the side opposite to the outer casing 4-1. Further, another drive wheel 46-3 is attached to the second rotary shaft 44 so as to be sandwiched between the outer casings 4-1 and 4-2. Namely, the driving apparatus of the carrying apparatus 2 is constituted as the two-shafts and six drive wheels. The drive wheels 46-1 to 46-3 are generally referred to as the drive wheel 46 hereinafter. Each drive wheel 46 is coupled to the speed change apparatus 14 through a transmitting means (not shown). A sub cableway 48-1 is suspended along the outside surface of the outer casing 4-1 in the longitudinal direction thereof. The sub cableway 48-1 is operated by the drive wheels 46-1 attached to the first and second rotary shafts 42 and 44. In addition, a sub cableway 48-2 is similarly suspended along the outside surface of the outer casing 4-2 in the longitudinal direction thereof. The sub cableway 48-2 is operated by the drive wheels 46-2 attached to the first and second rotary shafts 42 and 44. Further, the sub cableway 48-3 is suspended along the gap between the outer casings 4-1 and 4-2 in the longitudinal direction thereof. The sub cableway 48-3 is operated by the drive wheels 46-3 of the first and second rotary shafts 42 and 44. The sub cableways 48-1 to 48-3 are disposed in parallel with a main cableway 62, which will be explained hereinafter. The end portions of these sub cableways are fixed to fixing means such as standing trees, poles, and the like.

The sub cableways 48-1 and 48-2 as wound around the drive wheels 46-1 and 46-2 are supported by a supporting mechanism 50 having first and second supporting rollers 52 and 54. The first supporting roller 52 is attached to one end of a swing arm 56. The other end of the swing arm 56 is axially supported. Thus, the roller 52 can rotate around the other end of the swing arm 56 as a rotational center. One end of the swing arm 56 is pressed by a spring 58. The second supporting roller 54 is disposed between the drive wheel 46 and the first supporting roller 52 and is mounted to the outside portion of the outer casing 4. The sub cableways 48-1 to 48-3 are generally referred to as the sub cableway 48 hereinafter. When the sub cableway 48 is supported, the upper side thereof comes into contact with the lower side of the second supporting roller 54, and the lower side of the sub cableway 48 comes into contact with the upper side of the first supporting roller 52. Thus, the roller 52 is slightly moved by the pressing force of the sub cableway 48 against the pressing force of the spring 58, thereby supporting the sub cableway 48. The supporting mechanism 50 is constituted in this manner and attached to both side portions of the outer casing 4, namely, at four positions on the front and rear end portions of the outer casing 4.

Running wheel supporting brackets 60 are vertically upwardly attached above the coupling portions 6-1 and 6-2 which couple the outer casings 4-1 and 4-2. Running wheels 64 are attached to the brackets 60. The wheels 64 are guided by the main cableway 62 and run therealong. The main cableway 62 is suspended in parallel with the sub cableway 48. The brackets 60 are coupled by a reinforcing rod 66 which is disposed above the outer casing 4 in parallel therewith. Further, cableway slip-out preventing metal fittings 68 are attached to the upper end portions of the brackets 60 and projects downwardly along side the cable 62.

On the other hand, cambers 70 for running are attached to the bottom portions of the outer casings 4-1 and 4-2, thereby enabling the carrying apparatus 2 to be easily drawn and transported on the ground.

A receiver 72 to receive the radio waves is attached to the outer casing 4. The control commands received by the receiver 72 are sent to the hydraulic apparatus 16. In response to the control commands received, the hydraulic apparatus 16 performs the start, acceleration, and stop of the power source 10, the connection and disconnection of the clutch 12, and the switching operation of the speed change apparatus 14. The worker who works at a safe unobstructed location on the ground operates a transmitter (not shown) to transmit desired control commands to the receiver 72 by way of the radio waves.

The operation of the first embodiment will now be described. When the operator desires to operate the carrying apparatus 2, the operator first operates the transmitter so as to transmit the radio waves indicative of the control commands. The radio waves are received by the receiver 72. On the basis of the radio waves received, the receiver 72 sends the control commands to the hydraulic apparatus 16. In response to the control commands, the hydraulic apparatus 16 is made operative and drives the power source 10, clutch 12, and speed change apparatus 14. Thus, the first and second rotary shafts 42 and 44 are rotated, thereby driving the drive wheels 46. The sub cableways 48 are operated by the drive wheels 46, thereby moving the carrying apparatus 2. In this case, the running wheels 64 are guided by the main cableway 62 and run. After the carrying apparatus 2 is stopped at a desired position, the first and second hoisting means 18 and 20 are driven to lift up an object. The drive wheels 46 are again driven through the first and second rotary shafts 42 and 44 and the sub cableways 48 are operated, thereby moving the carrying apparatus 2 to a desired position. In this manner, the object is carried.

When the object is suspended, as shown in FIG. 2, both end portions of the object can be supported by the first and second cables 28 and 36. Therefore, the object can be stably suspended and swing of the carrying apparatus 2 is prevented. The running performance is improved.

According to the first embodiment, since the carrying apparatus is constituted as the two-shafts and six-drive wheels, the friction which is caused between the drive wheels 46 and sub cableways 48 can be enlarged. Thus, such inconveniences that the drive wheels 46 slip and the like when the carrying apparatus 2 is obliquely upwardly moved are avoided. On the contrary, when the carrying apparatus 2 is downwardly obliquely moved, the carrying apparatus can be effectively braked and the operating performance is improved. On the other hand, since three sub cableways 48 are arranged, the total weight of the carrying apparatus 2 and object to be conveyed which act on each sub cableway 48 can be reduced. Therefore, the cut-away of the sub cableways 48 can be avoided. Even if one or two sub cableways 48 are cut away, the carrying apparatus 2 can be held at a fixed position by the remaining sub cableway 48 and by the main cableway 62. The runaway of the carrying apparatus 2 can be prevented. The safety is improved.

Figure 3:
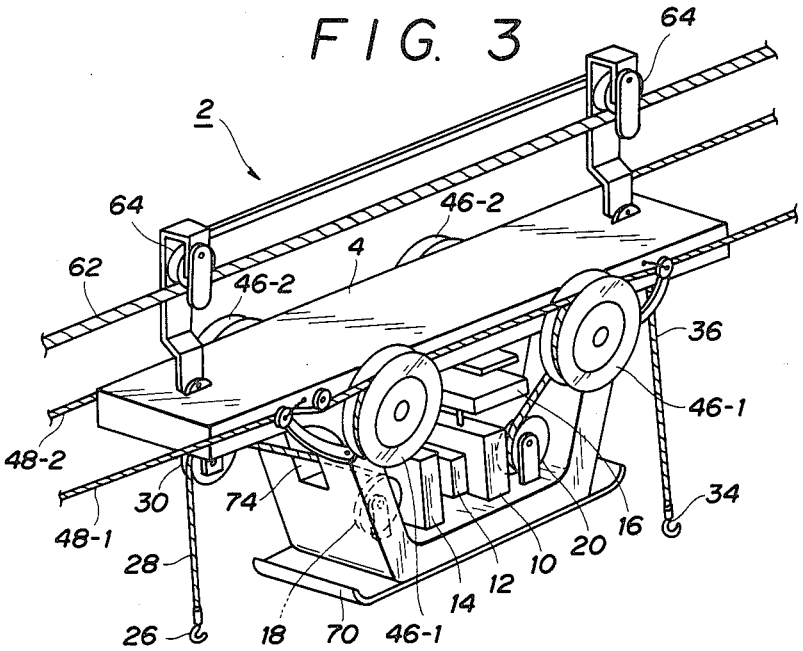
FIG. 3 is a perspective view illustrating the suspending state of the carrying apparatus according to the second embodiment of the invention.

FIG. 3 shows the second embodiment of the invention. In the second and subsequent embodiments and in the modified forms thereof, the parts and components having the same functions as those shown in the foregoing first embodiment are designated by the same reference numerals. It is a feature of the second embodiment that two drive wheels 46-1 and two drive wheels 46-2 are attached to only both outside portions of the outer casing 4 of the carrying apparatus 2 having the outer casing 4 formed by a single body. Reference numeral 74 denotes a hole or opening for the lifting cables.

With the second embodiment having such a constitution, the effects similar to those in the first embodiment can be derived. The constitution is simplified. This embodiment can be also easily applied to the existing carrying apparatus.

The present invention is not limited to the foregoing first and second embodiments but many variations and modifications are obviously possible.

Figure 4:
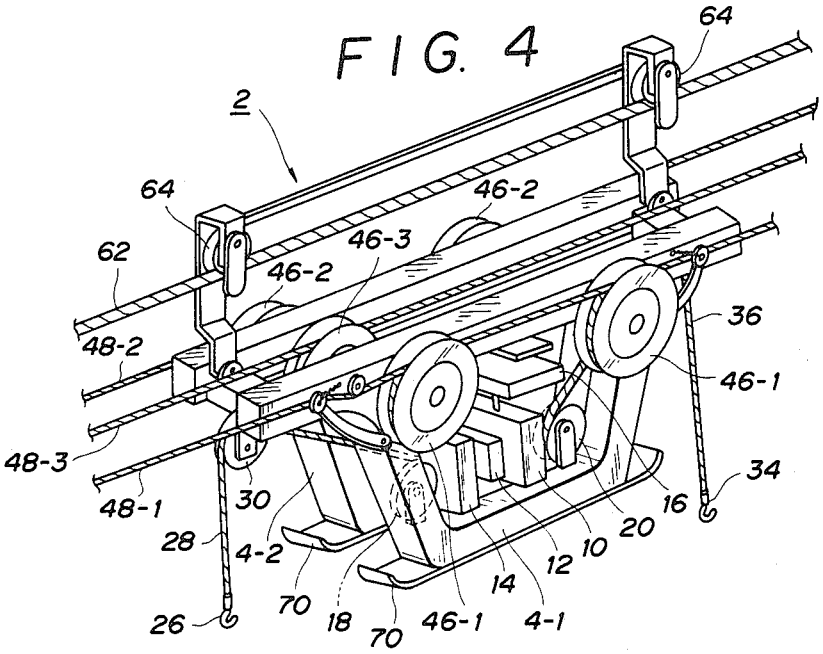
Figure 5:
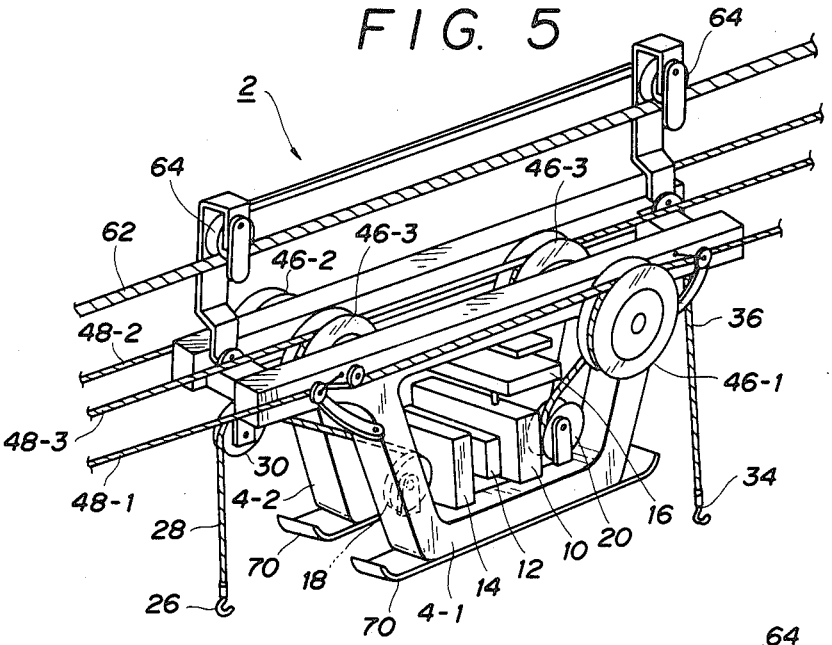

For example, the first embodiment has been constituted by a carrier arrangement having two-shafts and six-wheels. However, as shown in FIG. 4, it is also possible to constitute in such a manner that as shown in FIG. 4, the drive wheels 46-1 to 46-3 are attached to the first rotary shaft 42 and the drive wheels 46-1 and 46-2 are attached to the second rotary shaft 44, thereby providing a carrier arrangement with two-shafts and five-wheels. On the other hand, as shown in FIG. 5, it is also possible to constitute in such a manner that the drive wheels 46-2 and 46-3 are attached to the first rotary shaft 42 and the drive wheels 46-1 and 46-3 are attached to the second rotary shaft 44, thereby constructing arrangement with two-shafts and four-wheels. In the first embodiment, on the other hand, for example, as shown in FIGS. 7 to 10, the attaching positions and the number of drive wheels and the number of sub cableways may also be changed in accordance with the use situation such as steep slanting ground, flat ground, or the like. The sub cableways may be also selectively used.

Figure 6:
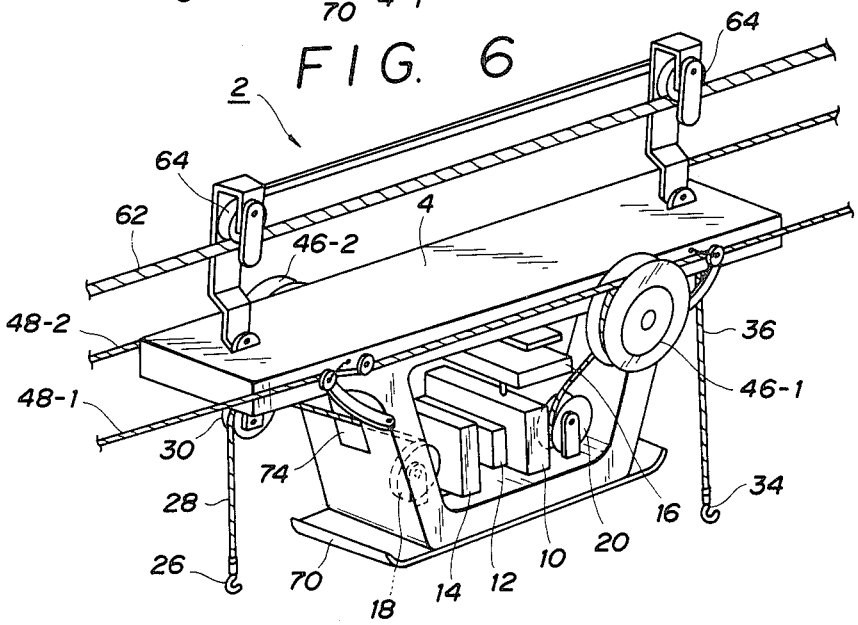
Figure 7:
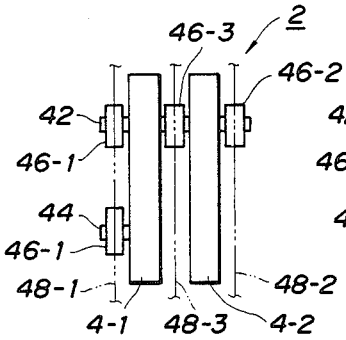
Figure 8:
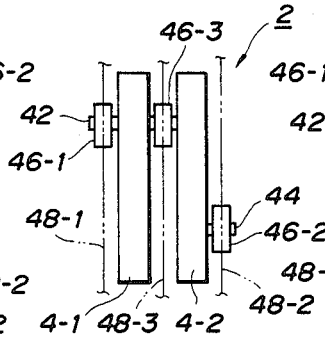
Figure 9:
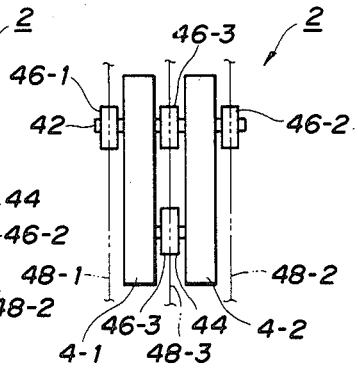
Figure 10:
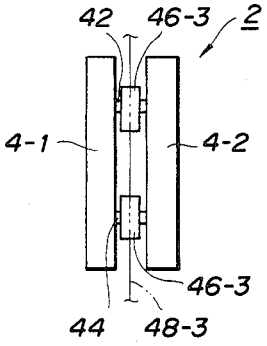
Figure 11:
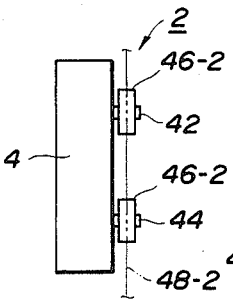
Figure 12:
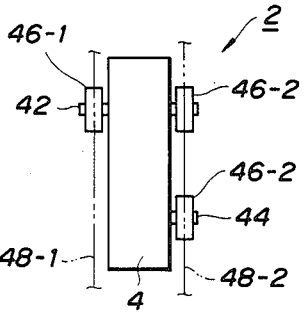

On the other hand, although the second embodiment has been constituted with two-shafts and four-wheels, it is also possible to simply constitute the carrier arrangement in such a manner that the drive wheel 46-2 is attached to the first rotary shaft 42 and the drive wheel 46-1 is attached to the second rotary shaft 44 as shown in FIG. 6. In the second embodiment as well, for example, as shown in FIGS. 11 and 12, the attaching positions and the number of drive wheels, and the number of sub cableways can be changed in accordance with the use situation such as slanting ground, flat ground, or the like. The sub cableways may be also selectively used.

Figure 13:
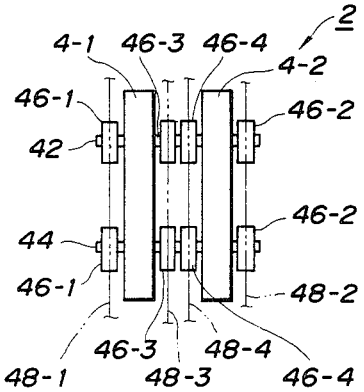
Figure 14:
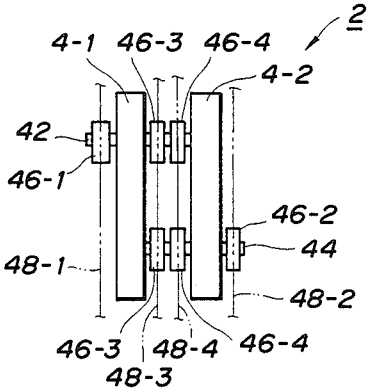

Further, for example, two-shafts and eight-wheels can be used as the carrier arrangement as shown in FIG. 13. The two-shafts and six-wheels can be also constituted as shown in FIG. 14.

Moreover, although two rotary shafts have been attached in the first and second embodiments, it is also possible that two or more rotary shafts are attached and the drive wheel is attached to each rotary shaft, thereby constructing the multi-shafts and a plurality of driving wheels.

FIGS. 15 to 18 show the third embodiment of the invention. Reference numeral 102 denotes a carrying apparatus and 104 denotes an outer casing made by a hollow body. The carrying apparatus 102 has two outer casings 104-1 and 104-2 which are arranged in parallel. The outer casings 104-1 and 104-2 are generally referred to as the outer casing 104 hereinafter. The outer casing 104-1 consists of a rectilinear first member 106-1 and a U-shaped second member 108-1 which is connected with the first member 106-1. The first member 106-1 is formed by a hollow body and has a first hollow portion 110-1. The second member 108-1 is also similarly formed by a hollow body and has a second hollow portion 112-1. The first and second hollow portions 110-1 and 112-1 are communicated. The outer casing 104-2 is constituted in the same manner as the outer casing 104-1; therefore, its description is omitted here.

On the other hand, the first and second hollow portions 110-1 and 112-1 can be also coupled without being communicated with each other. In this case, the first and second hollow portions 110-1 and 112-1 can individually store different kinds of liquids for use in a power unit 116, which will be explained hereinafter.

The outer casings 104-1 and 104-2 are disposed in parallel. A gap is formed between the first members 106-1 and 106-2. In order to communicate the first hollow portions 110-1 and 110-2, coupling portions 114-1 and 114-2 are connected to the front and rear end portions of the first members 106-1 and 106-2. In this case, the upper surfaces of the coupling portions 114-1 and 114-2 are lower than the upper surfaces of the first members 106-1 and 106-2 by a predetermined distance, thereby allowing a third sub cableway 142, which will be explained hereinafter, to pass. On the other hand, in order to communicate the second hollow portions 112-1 and 112-2, a coupling portion 114-3 is connected to the central portions of the second members 108-1 and 108-2. A space 118 is formed in the region which is defined by the first members 106-1 and 106-2 and second members 108-1 and 108-2 of the outer casings 104-1 and 104-2. The power unit 116 and hoisting means, which will be explained hereinafter, are set within the space 118. When the first and second hollow portions 110 and 112 are coupled without being communicated with each other, the fuel oil as the liquid to make the power source 122 of the power unit 116 operative is stored in the first hollow portion 110. The operating oil as the liquid to make the hydraulic apparatus 120 of the power unit 116 operative is stored into the second hollow portion 112. The first hollow portions 110-1 and 110-2 and the second hollow portions 112-1 and 112-2 are generally referred to as the first hollow portion 110 and the second hollow portion 112.

Figure 15:
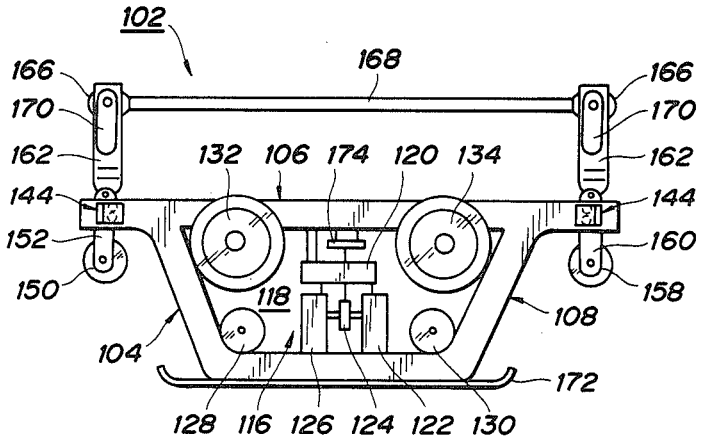
Figure 18:
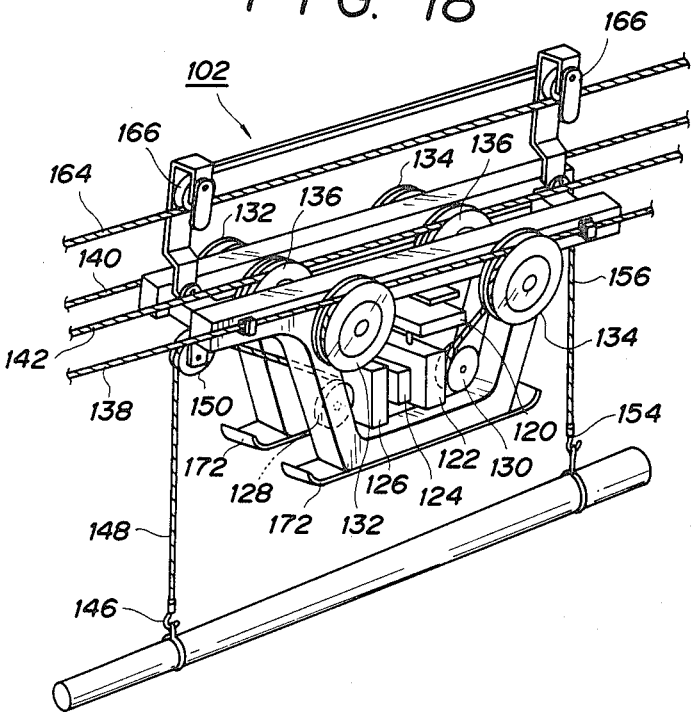
Figure 16:
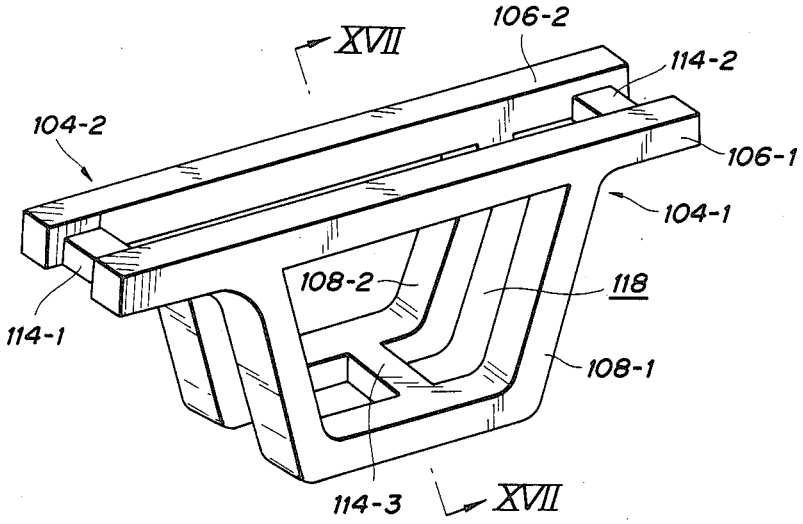
Figure 17:
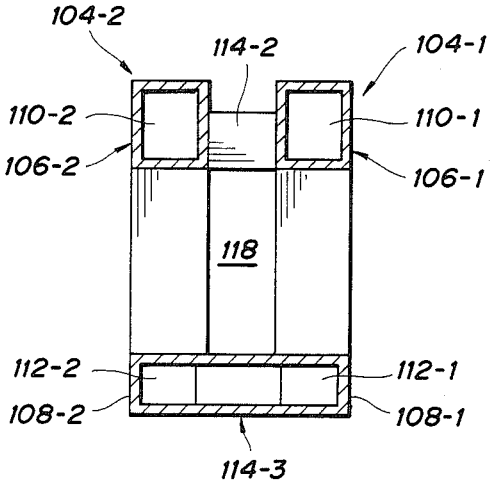

As shown in FIG. 15, the power unit 116 comprises: the power source 122 consisting of an internal combustion engine; a clutch 124; a speed change apparatus 126 such as an automatic speed change gear; and the hydraulic apparatus 120 consisting of a hydraulic motor or the like. Namely, these apparatuses are driven by the hydraulic apparatus 120. The power source 122 is connected to first and second hoisting means 128 and 130 through the clutch 124, speed change apparatus 126, and transmitting means (not shown). These hoisting means are respectively individually operated and attached onto the central portions of the second members 108.

On the other hand, first drive wheels 132 are coaxially attached to both side portions on the front sides of the outer casings 104-1 and 104-2 and project therefrom. Second drive wheels 134 are similarly coaxially attached to both side portions on the rear sides of the outer casings 104-1 and 104-2 and project therefrom. Third drive wheels 136 are attached between the outer casings 104-1 and 104-2 coaxially with each of the first and second drive wheels 132 and 134, respectively. Namely, the carrying apparatus 102 is constituted as the two-shafts and six-wheels. The first to third drive wheels 132, 134, and 136 are coupled with the speed change apparatus 126 through transmitting means (not shown), respectively. A first sub cableway 138 is wound around the first and second drive wheels 132 and 134 on one side of the outer casing 104. The first sub cableway 138 is operated by the first and second drive wheels 132 and 134, thereby moving the carrying apparatus 102. A second sub cableway 140 is wound around the first and second drive wheels 132 and 134 on the other side of the outer casing 104, namely, on the side opposite to the first sub cableway 138. Further, the third sub cableway 142 is wound around the central third drive wheels 136 sandwiched by the first and second drive wheels 132 and 134. Both ends of the first to third sub cableways 138, 140, and 142 are fixed to fixing means (not shown) such as standing trees, poles, and the like. Further, guide roller portions 144 are attached to both side portions on the front and rear end portions of the first members 106. The guide roller portions 144 guide and support the first and second sub cableways 138 and 140 wound around the first and second drive wheels 132 and 134. The first members 106-1 and 106-2 are generally referred to as the first member 106. The second members 108-1 and 108-2 are generally referred to as the second member 108. The guide roller portions 144 are constituted by: two vertical guide rollers for supporting the first and second sub cableways 138 and 140 in the horizontal direction; and two lateral guide rollers for supporting these sub cableways in the vertical direction. Thus, even if the first and second sub cableways 138 and 140 are directed in any direction, the guide roller portions 144 protect the sub cableways so as not to be cut away or damaged by the friction.

A first cable 148 is wound around the first hoisting means 128. A first hook 146 is attached to the free end of the first cable 148. The first cable 148 is vertically put down through the gap between the outer casings 104-1 and 104-2 and through a first guide pulley 150. The pulley 150 is supported by a first pulley supporting bracket 152 fixed to the lower portion of the coupling portion 114-1. Similarly, a second cable 156 is wound around the second hoisting means 130. A second hook 154 is attached to the free end of the second cable 156. The second cable 156 is vertically put down through the gap between the outer casings 104-1 and 104-2 and through a second guide pulley 158. The second guide pulley 158 is supported by a second pulley supporting bracket 160 fixed to the lower portion of the coupling portion 114-2. Therefore, by driving the first and second hoisting means 128 and 130, the first and second cables 148 and 156 are pulled in and out, thereby allowing the object to be hung up and down or laterally hung.

Running wheel supporting brackets 162 are vertically attached above the coupling portions 114-1 and 114-2 which couple the outer casings 104-1 and 104-2. Running wheels 166 are attached to the brackets 162. The wheels 166 are guided by a main cableway 164 and run. The main cableway 164 is suspended along the first to third sub cableways 138, 140, and 142. The brackets 162 are coupled by a reinforcing material 168 which is arranged in parallel with and above the first members 106. Further, cableway slip-out preventing metal fittings 170 are attached to the end portions of the brackets 162.

In addition, cambers 172 for running are attached to the bottom portions of the central portions of the second members 108 constituting the outer casings 104, thereby enabling the carrying apparatus 102 to be easily drawn and transported on the ground.

A receiver 174 to receive the radio waves is attached to the outer casing 104. On the basis of the control commands received by the receiver 174, the power source 122 is made operative and the hydraulic apparatus 120 performs the start, acceleration, and stop of the power source 122, the connection and disconnection of the clutch 124, and the switching operation of the speed change apparatus 126 in the same manner as mentioned above. The worker who works at a safe unobstructed location on the ground operates a transmitter (not shown) to transmit the control commands to the receiver 174 by way of the radio waves.

The operation of the third embodiment will now be described.

When the operator desires to operate the carrying apparatus 102, the operator first operates the transmitter to transmit the radio waves. The receiver 174 receives the radio waves indicative of the control commands and sends the control commands to the power source 122 and hydraulic apparatus 120. In response to the control commands, the power source 122 and hydraulic apparatus 120 are made operative, thereby driving the clutch 124 and speed change apparatus 126 through the operating oil stored in the second hollow portion 122 of the outer casing 104. Thus, the first to third drive wheels 132, 134, and 136 are driven, thereby operating the first to third sub cableways 138, 140, and 142 and moving the carrying apparatus 102. In this case, the running wheels 166 are guided by the main cableway 164 and run. After the carrying apparatus 102 is stopped at a desired position, the first and second hoisting means 128 and 130 are driven to lift up the object. The first to third drive wheels 132, 134, and 136 are again driven and the sub cableways are operated, thereby moving the carrying apparatus 102 to a desired position. In this manner, the object is conveyed.

According to the third embodiment, the fuel oil for the power source 122 is stored into the first hollow portion 110 of the outer casing 104 formed by the hollow body. The operating oil for the hydraulic apparatus 120 is stored into the second hollow portion 112 of the outer casing 104. Namely, the fuel oil and the operating oil are separately stored. The outer casing 104 can be used as the liquid tank for storing the liquid which is used by the power unit 116. Thus, there is no need to separately attach the operating oil tank and fuel oil tank as in the conventional carrying apparatus. Therefore, the number of parts can be reduced. The structure of the carrying apparatus 102 can be simplified and reduced in size. The carrying apparatus can be easily handled.

When the first and second hollow portions 110 and 112 are communicated, either one of the fuel oil for the power source 122 and the operating oil for the hydraulic apparatus 120 can be stored in those hollow portions.

Further, since the carrying apparatus has been constituted as the two-shafts and six-wheels, when the carrying apparatus 102 is obliquely upwardly moved, the friction between the drive wheels and the sub cableways is enlarged. Thus, the slip of the carrying apparatus and the like can be prevented. On the contrary, when the carrying apparatus 102 is downwardly moved, the carrying apparatus can be effectively braked. The runaway of the carrying apparatus is prevented. Thus, the operating performance is improved.

Moreover, since the first and second hoisting means 128 and 130 are provided, the object can be hung up at two positions thereof or two objects can be simultaneously hung up.

On the other hand, since three sub cableways are provided, even if one of the sub cableways is cut away, the carrying apparatus can be supported by the other sub cableways, so that it is safe.

The present invention is not limited to the foregoing third embodiment but many variations and modifications are obviously possible.

For example, in the third embodiment, the fuel oil and operating oil are stored in the outer casings formed by the hollow bodies. However, the cooling water and the like which are used in the power unit can be also stored in the outer casings.

The invention is not limited to the two-shafts and six-wheels but may be also constituted as one-shaft and two-wheels or two-shafts and four-wheels.

Although two outer casings are arranged in parallel, one outer casing may be also used.

Further, the first to third drive wheels 132, 134, and 136 can be selectively used.

The third sub cableway 142 can be also supported by a guide roller portion which is separately attached.

As will be obvious from the above detailed description, according to the invention, at least two rotary shafts are provided, the drive wheel is attached to each rotary shaft, and the sub cableway is wound around each drive wheel. Therefore, the frictions which are caused between the drive wheels and the sub cableways can be increased. When the carrying apparatus is obliquely upwardly moved, the slip of carrying apparatus and the like are prevented. When the carrying apparatus is downwardly moved, the carrying apparatus is effectively braked. The operating performance can be improved. In addition, the total weight of the carrying apparatus and object which acts on each sub cableway can be reduced, so that the cut-away of the sub cableways can be avoided. Even if one of the sub cableways is cut away, the carrying apparatus can be held at the fixed position by the remaining sub cableways and the main cableway and it is safe. Moreover, the sub cableways can be selectively wound around a desired drive wheel. The use efficiency can be improved.

The liquids which are used by the power unit are stored in the hollow portions of the outer casings formed by the hollow bodies and the outer casings are used as the liquid tanks. Thus, the operating oil tank of the hydraulic apparatus, the fuel oil tank, and the like do not need to be separately provided. The number of parts can be reduced. The constitution of the carrying apparatus can be simplified and reduced in size and weight. The carrying apparatus can be easily handled. The invention is practically useful.

Further, the outer casing is also used as the liquid tank for the power unit, thereby simplifying the structure of the carrying apparatus. In addition, by storing the liquids in almost of the outer casings, the carrying apparatus is balanced and the stability and safety can be also improved.

What is claimed is:

1. A radio control aerial automatic carrying system for carrying an object by a carrying apparatus suspended from a cableway, comprising:

an aerial main cableway for suspending the carrying apparatus;

running wheels engaged with said aerial main cableway;

an outer casing coupled with said running wheels, said outer casing being a hollow body;

a power source attached to said outer casing;

hoisting means which are wound and driven by said power source;

a receiver, attached to said outer casing, for receiving radio waves which are transmitted from a transmitter and for generating control commands to drive said power source and said hoisting means in response to said radio waves received;

at least two rotary shafts which are attached to said outer casing and rotated by said power source;

a sub cableway, suspended in parallel with said aerial main cableway, for supporting the carrying apparatus; and a plurality of drive wheels, attached to said rotary shafts, and engaged with said sub cableway for moving the carrying apparatus.

2. A carrying system according to claim 1, further comprising a power unit including a hydraulic apparatus and said power source, and wherein said power unit is attached in a space which is formed by said outer casing, and a liquid which is used by said power unit is stored in the hollow portion of said outer casing, thereby constituting the outer casing as a liquid tank.

3. A carrying system according to claim 2, wherein said outer casing is constituted by two hollow portions, and an operating oil for making said hydraulic apparatus operative and a fuel oil for driving said power source are individually stored in said two hollow portions, so that the outer casing is used as the two liquid tanks for the operating oil and the fuel oil.

4. A carrying system according to claim 2, wherein said outer casing is constituted by first and second outer casings which are coupled with each other.

5. A carrying system according to claim 4, wherein each of said first and second outer casings is formed by first and second members which are connected but are not communicated with each other, and different kinds of liquids are stored in said first and second members.

6. A carrying system according to claim 5, wherein said different kinds of liquids are an operating oil for making the hydraulic apparatus operative and a fuel oil for driving said power source.

7. A carrying system according to claim 6, wherein said carrying apparatus has the outer casing formed as one body, and two first said drive wheels are mounted adjacent one outside side portion of said outer casing and are engaged with one said sub cableway, and two second drive wheels are mounted adjacent an opposite outside side portion of said outer casing and are engaged with another said sub cableway.

8. A carrying system according to claim 7, wherein first to third said drive wheels are attached to a first said rotary shaft and are respectively engaged with first to third said sub cableways, and first and second said drive wheels are attached to a second said rotary shaft and are respectively engaged with different ones of said sub cableway.

9. A carrying system according to claim 8, wherein first and second said drive wheels are attached to a first said rotary shaft and respectively engaged with first and second said sub cableways, and third and fourth said drive wheels are attached to a second said rotary shaft and are engaged with said second sub cableway and a third said sub cableway respectively.

10. A carrying system according to claim 9, wherein a first said drive wheel is attached to a first said rotary shaft and engaged with a first said sub cableway, and a second said drive wheel is attached to a second said rotary shaft and engaged with a second said sub cableway.

11. A carrying system according to claim 1, wherein each said rotary shaft has at least one said drive wheel attached thereto, and wherein each said drive wheel has a said sub cableway wound therearound.

* * * * *

UNITED STATES PATENT AND TRADEMARK OFFICE

CERTIFICATE OF CORRECTION

PATENT NO. : 4 754 886

DATED : July 5, 1988

INVENTOR(S) : Kozo HIRANO

It is certified that error appears in the above-identified patent and that said Letters Patent is hereby corrected as shown below:

Column 12, Line 27; Change "Claim 6" to ---Claim 11---.
Line 35; Change "Claim 7" to ---Claim 11---.
Line 42; Change "Claim 8" to ---Claim 11---.
Line 49; Change "Claim 9" to ---Claim 11---.

Signed and Sealed this

Seventh Day of February, 1989

*Attest:*

*Attesting Officer*

DONALD J. QUIGG

*Commissioner of Patents and Trademarks*